US011164686B2

(12) United States Patent
Son et al.

(10) Patent No.: US 11,164,686 B2
(45) Date of Patent: Nov. 2, 2021

(54) METHOD FOR MANUFACTURING SOLID INSULATION MEMBER AND INSULATION MEMBER THEREOF

(71) Applicant: HYOSUNG HEAVY INDUSTRIES CORPORATION, Seoul (KR)

(72) Inventors: Jun Ho Son, Seoul (KR); Dong Jin Park, Seongnam-si (KR); Jae Yong Sim, Anyang-si (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 8 days.

(21) Appl. No.: 16/957,258

(22) PCT Filed: Dec. 19, 2018

(86) PCT No.: PCT/KR2018/016277
§ 371 (c)(1),
(2) Date: Jun. 23, 2020

(87) PCT Pub. No.: WO2019/132402
PCT Pub. Date: Jul. 4, 2019

(65) Prior Publication Data

US 2020/0395149 A1 Dec. 17, 2020

(30) Foreign Application Priority Data

Dec. 28, 2017 (KR) ..... 10-2017-0183189

(51) Int. Cl.
*H01B 19/04* (2006.01)
*H01B 17/32* (2006.01)
(Continued)

(52) U.S. Cl.
CPC ..... *H01B 19/04* (2013.01); *H01B 17/32* (2013.01); *H01B 17/66* (2013.01); *H01B 3/305* (2013.01);
(Continued)

(58) Field of Classification Search
CPC ..... H01B 3/305; H01B 3/426; H01B 17/32; H01B 17/66; H01B 19/04
(Continued)

(56) References Cited

U.S. PATENT DOCUMENTS

2005/0042424 A1* 2/2005 Frey ..... B06B 1/0622 428/172
2011/0000704 A1* 1/2011 Yoon ..... H05K 1/036 174/258
(Continued)

FOREIGN PATENT DOCUMENTS

JP 2010-212209 A 9/2010
KR 10-2015-0113723 A 10/2015
(Continued)

*Primary Examiner* — William H. Mayo, III
(74) *Attorney, Agent, or Firm* — Novick, Kim & Lee, PLLC; Jae Youn Kim

(57) ABSTRACT

The method of manufacturing the insulation member includes manufacturing a 3D printing material using a mixed material in which one or more materials selected from among polycarbonate (PC), polybutylene terephthalate (PBT), acrylonitrile-butadiene-styrene (ABS), polyamide (PA), polyoxymethylene (POM), and polyethylene terephthalate (PET), one or more fillers selected from among TiO2, SiO2, and AlO3, and a curing agent are mixed, and which contains different amounts of the fillers at predetermined intervals in a longitudinal direction, and sequentially stacking the manufactured 3D printing material using a 3D printer to thus manufacture a target insulation member so that the mixed material containing different amounts of the fillers at predetermined intervals in a longitudinal direction of the insulation member is sequentially stacked.

15 Claims, 7 Drawing Sheets

(51) Int. Cl.

| | |
|---|---|
| ***H01B 17/66*** | (2006.01) |
| *H01B 3/30* | (2006.01) |
| *H01B 3/42* | (2006.01) |
| *H01B 3/44* | (2006.01) |
| *H01B 3/46* | (2006.01) |

(52) U.S. Cl.
CPC ..... *H01B 3/426* (2013.01); *H01B 3/427* (2013.01); *H01B 3/447* (2013.01); *H01B 3/46* (2013.01)

(58) Field of Classification Search
USPC ..... 174/137 R, 140 R, 144, 148, 149 R, 150
See application file for complete search history.

(56) References Cited

U.S. PATENT DOCUMENTS

2012/0067632 A1* 3/2012 Nakai ..... H05K 3/027 174/258
2017/0287595 A1* 10/2017 Holzmueller ..... F04D 13/0693

FOREIGN PATENT DOCUMENTS

KR 10-2016-0023874 A 3/2016
KR 10-2016-0082436 A 7/2016
KR 10-2017-0118679 A 10/2017

* cited by examiner

METHOD FOR MANUFACTURING SOLID INSULATION MEMBER AND INSULATION MEMBER THEREOF

TECHNICAL FIELD

The present invention relates to a method of manufacturing a solid insulation member. More particularly, the present invention relates to a method of manufacturing a solid insulation member used to maintain an insulated state between conductors, and an insulation member thereof.

BACKGROUND ART

A solid insulation member is added between conductors and linked thereto to maintain an insulated state between the conductors while maintaining the spacing between the conductors. For example, a gas insulation switchgear (GIS) generally includes a solid insulation member to support a conductor and to establish a section of insulation gas (SF6) in an enclosure thereof. This insulation member is commonly called a spacer.

Typically, a mixture of bisphenol-A-type epoxy and a filler is cast, primarily cured, and demolded for use as the insulation member in the GIS. Shape optimization and shield rings are applied for the purpose of attenuation of a maximum electric field at a portion of the insulation member linked to the enclosure or the central conductor.

However, the above-described conventional technology has problems in that there is a limit in the extent to which an electric field is attenuated due to the compactness of the product, the shape is complicated, and manufacturing costs are increased.

Further, research and development has been conducted on conventional FGM (functionally graded material) spacers, obtained by spatially changing the distribution of permittivity in spacers of a GIS. From analysis and tests, it was confirmed that the maximum electric field was attenuated by 20 to 30%.

This is the current method of manufacturing a spacer using centrifugal force, but it is difficult to control the permittivity of each layer. Accordingly, this method is not applied to products in practice.

DISCLOSURE

Technical Problem

Accordingly, the present invention has been made keeping in mind the above problems occurring in the prior art, and an object of the present invention is to provide a method of manufacturing a solid insulation member, in which a filament is applied to a 3D printer so that stacking is performed to form predetermined layers, thus manufacturing a solid linking member, and a solid insulation member manufactured using the same.

Another object of the present invention is to provide a method of manufacturing a solid insulation member, in which the shape and the distribution of permittivity of the solid insulation member are freely set, and a solid insulation member manufactured using the same.

Yet another object of the present invention is to provide a method of manufacturing an insulation member, in which the insulation performance for each target portion of the insulation member is improved and a maximum electric field at a portion coupled to a conductor is attenuated, and an insulation member thereof.

Technical Solution

A method of manufacturing an insulation member according to the present invention includes manufacturing a 3D printing material using a mixed material in which one or more materials selected from among polycarbonate (PC), polybutylene terephthalate (PBT), acrylonitrile-butadiene-styrene (ABS), polyamide (PA), polyoxymethylene (POM), and polyethylene terephthalate (PET), one or more fillers selected from among $TiO_2$, $SiO_2$, and $Al_2O_3$, and a curing agent are mixed and which contains different amounts of the fillers at predetermined intervals in a longitudinal direction, and sequentially stacking the manufactured 3D printing material using a 3D printer to thus manufacture a target insulation member so that the mixed material containing different amounts of the fillers at predetermined intervals in a longitudinal direction of the target insulation member is sequentially stacked.

Further, a method of manufacturing an insulation member according to another embodiment of the present invention includes manufacturing n 3D printing materials using mixed materials in which one or more materials selected from among polycarbonate (PC), acrylonitrile-butadiene-styrene (ABS), polyamide (PA), polybutylene terephthalate (PBT), polyoxymethylene (POM), and polyethylene terephthalate (PET), one or more fillers selected from among $TiO_2$, $SiO_2$, and $Al_2O_3$, and a curing agent are mixed and which contain mutually different amounts of the fillers, and sequentially stacking the manufactured n 3D printing materials using a 3D printer to thus manufacture a target insulation member so that a first 3D printing material to a n-th 3D printing material of the n 3D printing materials are stacked at predetermined intervals in a longitudinal direction of the insulation member.

The stacking is performed so that an amount of the filler is gradually increased stepwise from one side to another side in the longitudinal direction of the insulation member, thus manufacturing the insulation member.

The stacking is performed so that an amount of the filler is gradually reduced stepwise from one side to a central part in the longitudinal direction of the insulation member and so that the amount of the filler is gradually increased from the central part to another side for each layer, thus manufacturing the insulation member.

When the 3D printing material is stacked to manufacture the insulation member, the stacking is performed so as to be inclined at a predetermined angle relative to a virtual vertical line formed in the longitudinal direction of the insulation member.

Further, the present invention provides a solid insulation member manufactured using the two above-described methods of manufacturing the solid insulation member.

Further, a solid insulation member according to the present invention includes a mixed material in which one or more materials selected from among polycarbonate (PC), polybutylene terephthalate (PBT), acrylonitrile-butadiene-styrene (ABS), polyethylene terephthalate (PET), polyamide (PA), and polyoxymethylene (POM), one or more fillers selected from among $TiO_2$, $SiO_2$, and $Al_2O_3$, and a curing agent are mixed. The mixed material containing different amounts of the fillers at predetermined intervals in a longitudinal direction is stacked.

The stacking is performed so that an amount of the filler is gradually increased stepwise from one side to another side in the longitudinal direction of the insulation member.

The stacking is performed so that an amount of the filler is gradually increased stepwise from one side to a central part in the longitudinal direction of the insulation member and so that the amount of the filler is gradually reduced stepwise from the central part to another side.

The stacking is performed so as to be inclined at a predetermined angle relative to a virtual vertical line formed in the longitudinal direction of the insulation member.

A mixed material is stacked so as to contain a filler in an amount that is relatively larger in a terminal end of the insulation member, defined by a virtual central line forming an acute angle in a longitudinal direction with respect to a virtual horizontal line perpendicular to the virtual vertical line, than in a portion other than the terminal end.

Advantageous Effects

According to the present invention, it is possible to improve the insulation performance for each target portion of an insulation member, and to attenuate the maximum electric field at a portion coupled to a conductor.

Further, according to the present invention, a 3D printing material is melted using a 3D printer and then stacked at predetermined intervals to thus manufacture an insulation member. Accordingly, costs are reduced and manufacturing is simple.

Further, according to the present invention, when the insulation member is manufactured, it is possible to freely control the shape and permittivity thereof.

BEST MODE

Figure 1:
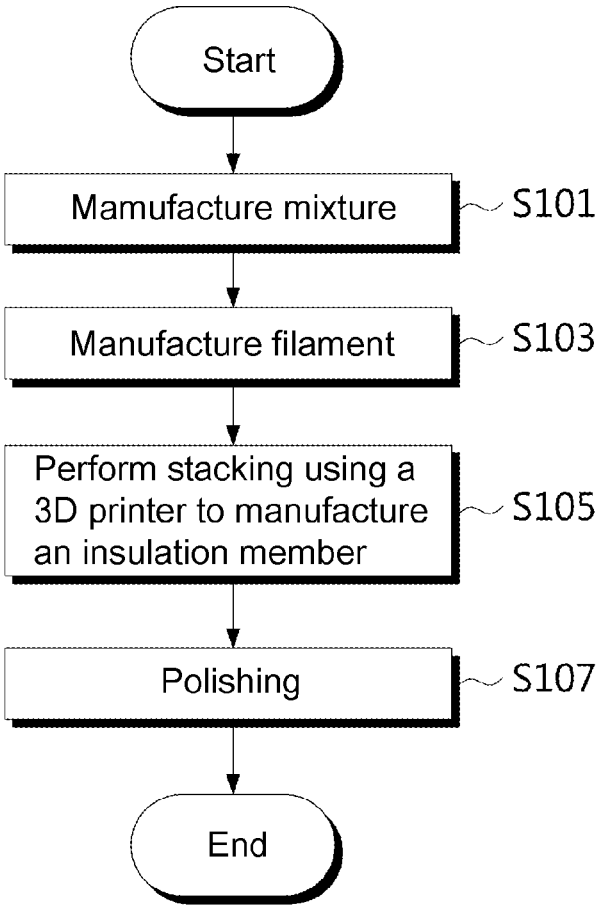
FIG. 1 is a flowchart showing a method of manufacturing a solid insulation member according to the present invention.

Hereinafter, embodiments of the present invention will be described in detail with reference to exemplary drawings. It should be noted with regard to the reference numerals assigned to the components in each drawing, the same components have the same reference numerals as far as possible, even when they are displayed in different drawings. Further, in describing the embodiments of the present invention, when it is determined that detailed descriptions of related well-known structures or functions would interfere with understanding of the embodiments of the present invention, such detailed descriptions thereof are omitted.

Further, in describing the components of the embodiments of the present invention, terms such as first, second, A, B, (a), and (b) can be used. These terms are used only to distinguish components from other components, and the nature, order, or sequence of the components is not limited by the terms. When a component is described as being "linked", "coupled", or "connected" to another component, it is to be understood that the component may be directly linked or connected to the other component, and that a further component may be "linked", "coupled", or "connected" to each of the components.

FIG. 1 is a flowchart showing a method of manufacturing a solid insulation member according to an embodiment of the present invention. Referring to FIG. 1, the method of manufacturing the solid insulation member according to the present invention includes manufacturing a mixture including a thermoplastic resin, a filler, and a curing agent mixed with each other therein at step S101, manufacturing a 3D printing material using the mixture at step S103, stacking the 3D printing material using a 3D printer to manufacture an insulation member at step S105, and polishing the manufactured insulation member at step S107.

The 3D printing material is manufactured using a mixed material in which one or more materials selected from among polycarbonate (PC), polybutylene terephthalate (PBT), polyoxymethylene (POM), acrylonitrile-butadiene-styrene (ABS), polyamide (PA), and polyethylene terephthalate (PET), one or more fillers selected from among titanium dioxide ($TiO_2$), silicon dioxide ($SiO_2$), and aluminum oxide ($Al_2O_3$), and a predetermined curing agent that is required are mixed. The mixed material is obtained by performing mixing in a vacuum.

In the present embodiment, preferably, the amount of one or materials selected from among PC, PBT, POM, ABS, PA, and PET is 5 to 50 wt % and the amount of the filler is 5 to 25 wt % based on the total wt %. The filler serves to determine the permittivity of the insulation member, and a binder serves to fix filler particles when the 3D printing material is manufactured. Various materials may be used as the curing agent. For example, a thermosetting resin such as phenol or polyimide may be used.

As described in the above, the 3D printing material is manufactured using the mixed material. For example, when the 3D printing material is manufactured in the form of a filament, extrusion is performed using an extruder. In this extrusion step, after heating is performed to the melting temperature of the mixture in the extruder, the filament is extruded through the nozzle of the extruder so as to ensure a desired diameter or thickness. During the extrusion into the filament, the melting temperature and the screw temperature of the extruder may be set depending on the type of mixed material. The diameter of the nozzle may be appropriately adjusted in order to determine the diameter of the extruded filament.

Further, the 3D printing material may be manufactured in the form of a cartridge used in a PolyJet 3D printer. The 3D printing material presented by the present invention is used as a general term for materials used in a 3D printer. For example, the 3D printing material may be manufactured in the form of a filament or a cartridge.

Hereinafter, for convenience of description, an example of manufacturing a 3D printing material in the form of a filament will be described.

Figure 2:
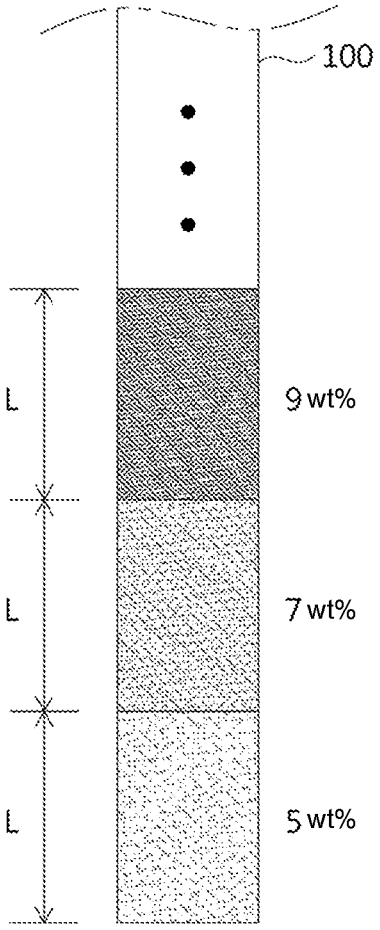
FIG. 2 is a cross-sectional view of a first 3D printing material according to an embodiment of the present invention.
Figure 3:
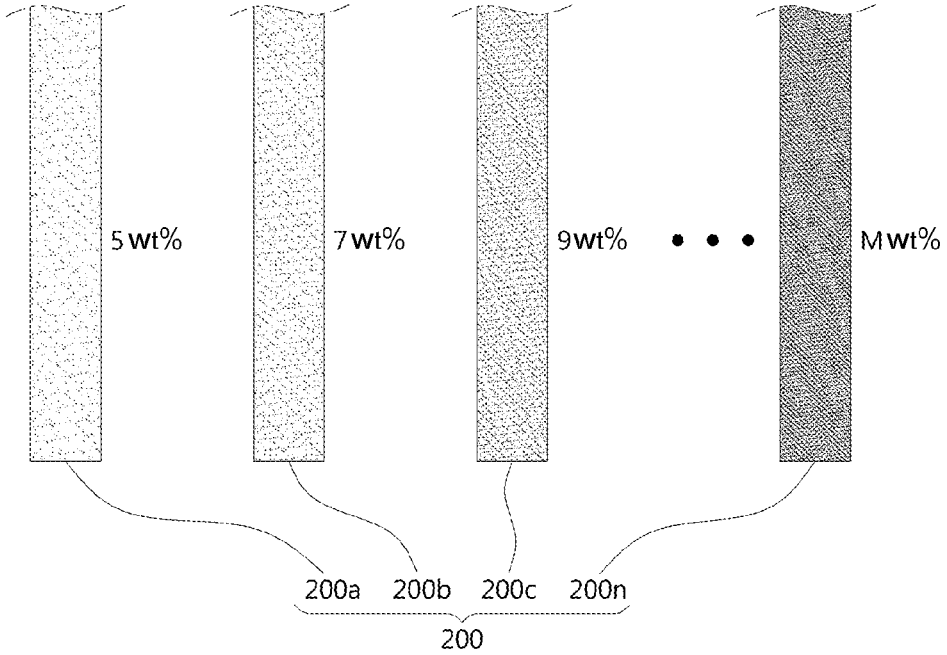
FIG. 3 is a cross-sectional view of a plurality of second 3D printing materials according to another embodiment of the present invention.

The above process is performed to manufacture the 3D printing materials illustrated in the cross-sections shown in FIGS. 2 and 3. In the present invention, the 3D printing materials are manufactured according to two embodiments.

For example, FIG. 2 is a cross-sectional view of a first filament according to an embodiment of the present invention, and FIG. 3 is a cross-sectional view of a plurality of second filaments according to another embodiment of the present invention.

Referring to FIG. 2, first, a first filament 100 according to an embodiment of the present invention is manufactured using a mixed material containing different amounts of the filler at predetermined intervals in the longitudinal direction. As illustrated in the drawings, the first filament 100 is manufactured so that a portion of the first filament having a first length L in a longitudinal direction of the filament 100 includes the mixed material containing 5 wt % of the filler based on the total wt %. The first filament is manufactured so that a portion of the first filament having another length L includes the mixed material containing 7 wt % of the filler and so that a portion of the first filament having a further length L includes the mixed material containing 9 wt % of the filler. As such, the first filament is manufactured so that portions of the first filament having different lengths L include the mixed materials containing different amounts of the filler. This is to discretely distribute the permittivity of the filament at predetermined intervals.

As described above, the filament is manufactured using the mixed material containing different amounts of the filler at predetermined intervals, and the content of the filler may be increased or decreased at the same ratio in the longitudinal direction of the filament. Further, unlike this, the content of the filler may be increased or decreased at different ratios therein. This may be varied depending on the environment in which the insulation member is to be actually used.

Referring to FIG. 3, a plurality of second filaments 200 (n second filaments) according to another embodiment of the present invention are manufactured using mixed materials containing mutually different amounts of the filler. That is, as shown in the drawing, a first filament 200*a* is manufactured using, for example, a mixed material containing 5 wt % of the filler, a second filament 200*b* is manufactured using a mixed material containing 7 wt % of the filler, and a third filament 200*c* is manufactured using a mixed material containing 9 wt % of the filler. As such, an n-th filament 200*n* is manufactured using a mixed material containing m wt % of the filler.

When the 3D printing material is manufactured in the form of a cartridge used in a PolyJet 3D printer as described above, a material having permittivity varying depending on each of a plurality of cartridges may be used.

Each of the filaments 100 and 200 manufactured as shown in FIGS. 2 and 3 is successively stacked using a 3D printer to thus manufacture a target insulation member, followed by appropriate polishing, whereby the manufacture of the target insulation member is finished. This will be described in detail with reference to FIG. 4.

Figure 4:
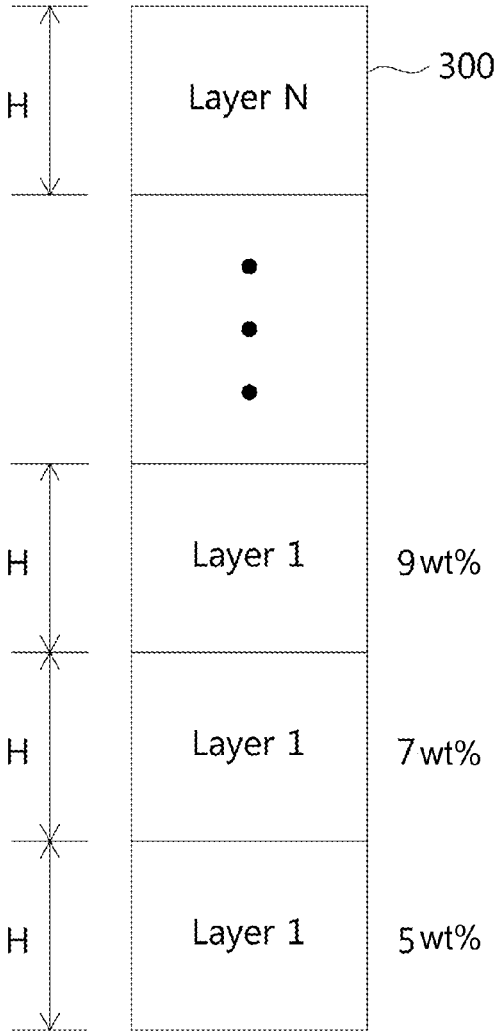
FIG. 4 is a cross-sectional configuration diagram of the insulation member manufactured by stacking the 3D printing material according to the embodiment of the present invention.

FIG. 4 is a cross-sectional configuration diagram of the insulation member manufactured by stacking the filament according to the embodiment of the present invention. Referring to FIG. 4, an insulation member 300 according to the present invention is manufactured so that a mixed material containing different amounts of the filler at predetermined intervals in a longitudinal direction is sequentially stacked. Although the cross-sectional view of an exemplary insulation member is shown in the drawing, as long as the actual insulation member is capable of being manufactured by stacking the filament using a 3D printer, the insulation member is capable of being manufactured so as to have various shapes.

As shown in the drawing, a first layer (layer 1) having a first length H in a longitudinal direction of the cross section of the insulation member 300 is obtained by stacking a filament of a mixed material containing 5 wt % of the filler. A second layer (layer 2) having another length H is obtained by stacking a filament of a mixed material containing 7 wt % of the filler on the upper surface of the first layer. A third layer (layer 3) having a further length H is obtained by stacking a filament of a mixed material containing 9 wt % of the filler on the upper surface of the second layer. Subsequently, the filaments of the mixed material having different amounts of the filler for each of the other lengths H are sequentially stacked, thereby completing the manufacture of the insulation member. This is to discretely distribute the permittivity of the insulation member at predetermined intervals.

When the insulation member is manufactured, two manufacturing methods are provided. For example, the filament 100 of FIG. 2 is applied to a 3D printer and then melted to perform stacking. It is preferable that the 3D printer be a FDM (fused deposition modeling)-type 3D printer for melting filaments and then performing stacking. Since the filament 100 includes the mixed material in which different amounts of fillers are mixed at predetermined intervals in a longitudinal direction, the mixed material in which the same fillers are mixed is stacked so as to form the same layer in a 3D printer when the insulation member 300 is manufactured. That is, stacking is performed so that the mixture containing different amounts of the filler at predetermined intervals in the insulation member 300 constitutes different layers for each length of the filament 100.

In another embodiment, n filaments 200 of FIG. 3 are applied to one or more 3D printers, thus being melted and then stacked. Specifically, the first filament 200*a* is stacked as a first layer of the insulation member 300, the second filament 200*b* is stacked as a second layer, and in this sequential manner, the n-th filament 200*n* is stacked as an n-th layer. Through the above stacking procedure, the n filaments 200 having the mixed materials containing different fillers are stacked so as to form the first to n-th layers.

Preferably, stacking is performed so that the amount of the filler is gradually increased or reduced for each layer from one side to another side in the longitudinal direction of the cross section, thus manufacturing the insulation member 300 according to the present invention. Alternatively, the amount of the filler for each layer may be continuously increased or reduced, and discontinuous or discrete distribution may be achieved. To this end, the method of manufacturing the filament 100 of FIG. 2 and the stacking order of the filament 200 of FIG. 3 may be changed.

Figure 5:
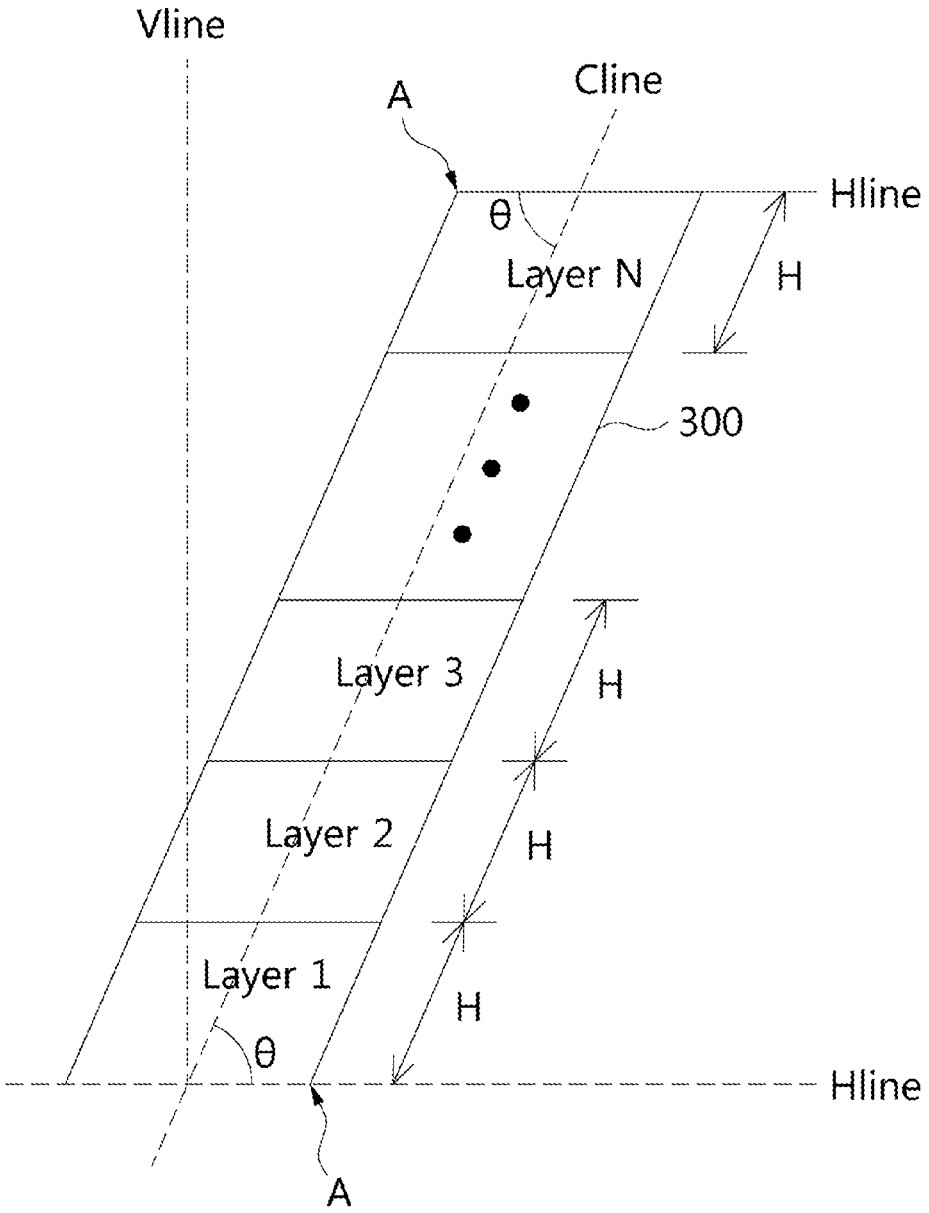
FIG. 5 is an exemplary view showing the cross-sectional shape of the insulation member according to the present invention.

FIG. 5 is an exemplary view showing the cross-sectional shape of the insulation member according to the embodiment of the present invention. Referring to FIG. 5, the insulation member 300 may be manufactured by performing stacking so that the insulation member is inclined at a predetermined angle with respect to the ground. This means that stacking is performed so that the insulation member is inclined at a predetermined angle (0) relative to a virtual vertical line Vline formed in the longitudinal direction of the insulation member 300 with respect to the ground.

Further, in the embodiment of the present invention, stacking may be performed so that the amount of the filler is gradually reduced for each layer from one terminal end to a central part in the longitudinal direction of the insulation member and the amount of the filler is gradually increased from the central part to another terminal end for each layer, thus manufacturing the insulation member 300. This may be determined depending on the type of product to which the insulation member 300 is applied.

For example, when the insulation member 300 is used as a spacer that is linked between a central conductor and an enclosure in a gas insulation switchgear, the parts that are in contact with the central conductor and the enclosure and the central part of the spacer may include respectively different fillers. This is to increase the permittivity by including a large amount of filler because the insulation internal pressure needs to be high in parts that come into contact with the central conductor and the enclosure.

As described above, when stacking is performed so that the insulation member 300 is inclined at a predetermined angle (θ), it is preferable to stack the mixed material which contains the filler in an amount that is relatively larger in a terminal end A of the insulation member 300 defined by a virtual central line Cline forming an acute angle in a longitudinal direction with respect to a virtual horizontal line Hline perpendicular to the virtual vertical line Vline than in a portion other than the terminal end A. This is to increase the permittivity because the insulation internal pressure needs to be high in the terminal end forming an acute angle when the spacer comes into contact with the central conductor or the enclosure, as described above.

Figure 6:
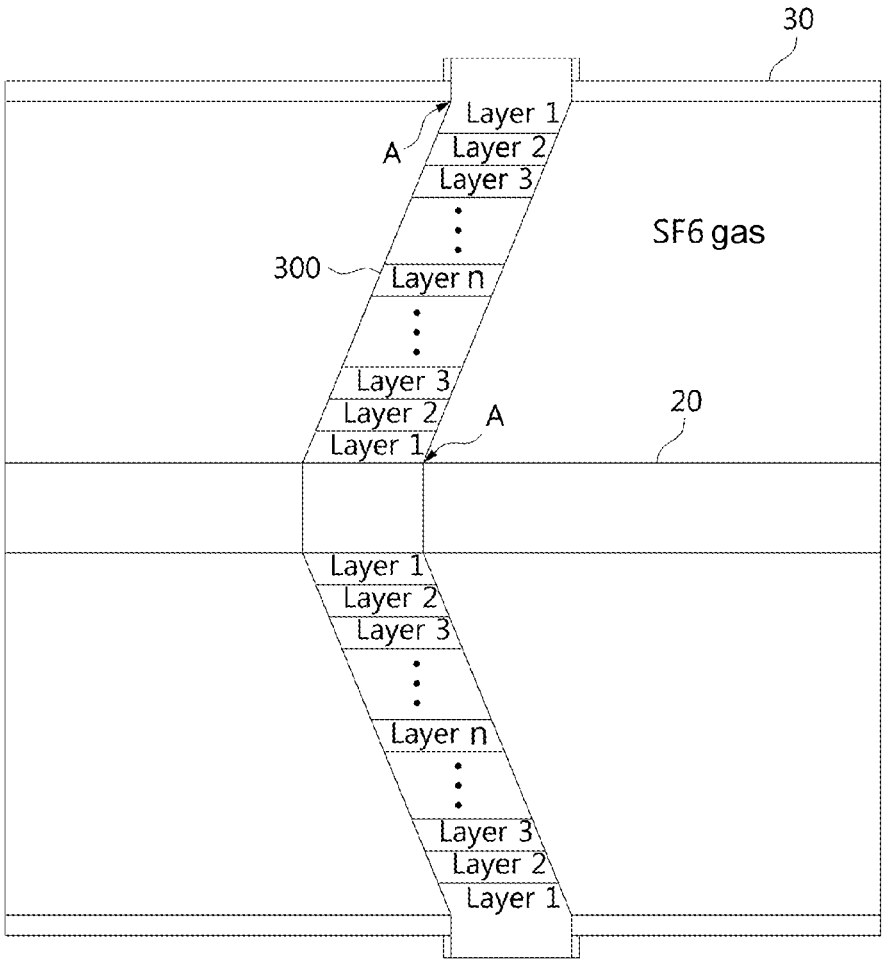
FIG. 6 is an exemplary view showing the cross section of the solid insulation member according to the embodiment of the present invention applied as a spacer inside a gas insulation switchgear.

FIG. 6*a* is an exemplary view showing the solid insulation member according to the embodiment of the present invention applied to a gas insulation switchgear, and FIG. 6*b* is an exemplary view showing the cross-section of the solid insulation member according to the present invention applied as a spacer inside a gas insulation switchgear. Referring to FIG. 6, the insulation member 300 is used for the purpose of insulation and support between a central conductor 20 and an enclosure 30. In the enclosure 30, an insulation gas, for example, SF6 gas, is present.

As shown in the illustrated example, the insulation member 300 serves to establish a section of an internal insulation gas (for example, SF6) while performing linking and supporting between the central conductor 20 and the enclosure 30. The materials containing different fillers at predetermined intervals in the longitudinal direction of the cross section of the insulation member 300 are stacked. That is, the insulation member is manufactured so as to have different permittivities at predetermined intervals in the longitudinal direction of the cross section thereof.

For example, in FIG. 6*b*, first, second, third, . . . , and n-th layers (layer 1 to layer n) are stacked from one terminal end linked to the central conductor 20 to the central part. In contrast, n-th, n−1-th, n−2-th, . . . , and first layers (layer n to layer 1) are stacked from the central part to the other terminal end. In this case, it is preferable to perform stacking so that the permittivity is gradually increased or reduced from one terminal end to the central part. Therefore, inversely, it is preferable to perform stacking so that the permittivity is gradually reduced or increased from the central part to the other terminal end. Of course, this is only an example, and stacking may be performed so that the layers have different permittivities, or stacking may be performed so that the neighboring layers have different permittivities.

In particular, as shown in FIG. 6, when the insulation member 300 is linked obliquely as a spacer between the central conductor 20 and the enclosure 30, an electric field is concentrated on portions A where the spacer and the conductor 20 form an acute angle at one end and the spacer and the enclosure 30 form an acute angle and the other end. Accordingly, it is necessary to increase the insulation internal pressure. Therefore, a material containing a relatively greater amount of filler is stacked on the portions A at which the acute angle is formed.

Figure 7:
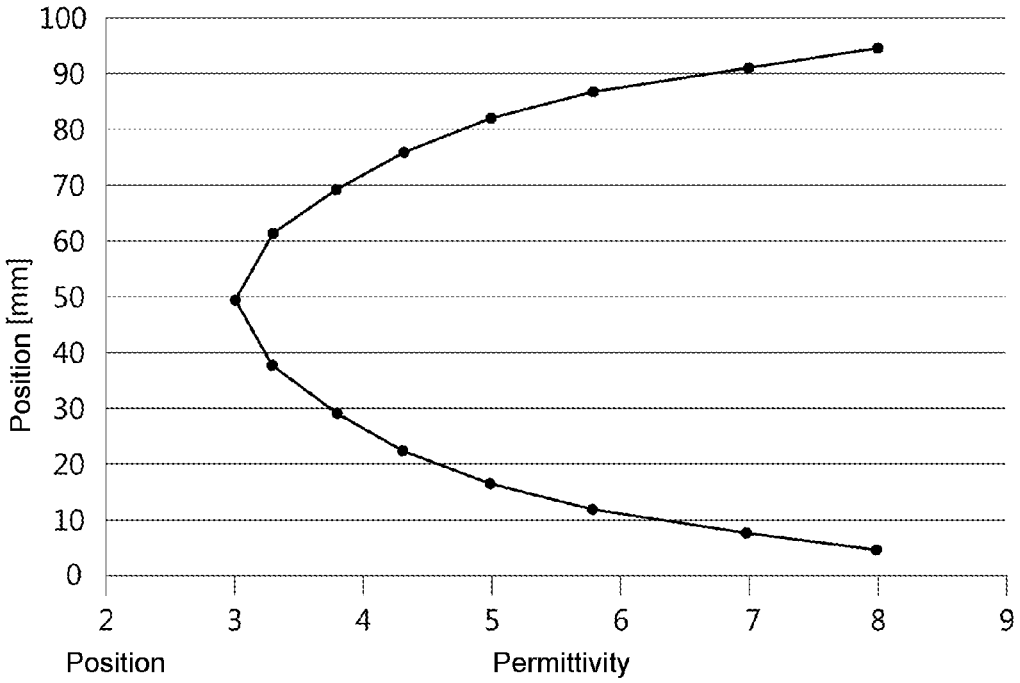
FIG. 7 is a view showing the experimental result of the permittivity for each position of a spacer when the insulation member is applied as a GIS spacer, as in FIG. 6.

FIG. 7 is a view showing the experimental result of the permittivity for each position of a spacer when the insulation member is applied as a GIS spacer, as shown in FIG. 6. As shown in FIG. 7, the amount of filler for each position of the spacer may be adjusted to thus control the permittivity for each position, and as in the embodiment of the drawing, the permittivity may be greater in one end of the upper portion and the other end of the lower portion than in the central part. This serves to attenuate the electric field of the portion linked to the enclosure and the central conductor.

INDUSTRIAL APPLICABILITY

As described above, in the present invention, an insulation member is manufactured according to a stacking method using a 3D printer. Accordingly, it is possible to manufacture the insulation member at low cost using a simple method. It is important that the insulation member have different permittivities at predetermined intervals in the longitudinal direction thereof. To this end, stacking is performed using a mixed material containing different amounts of the filler at predetermined intervals in the longitudinal direction of the insulation member.

As such, in the insulation member according to the present invention, the distribution of the internal permittivity is continuously or discontinuously changed, whereby it is possible to reduce the maximum electric field of a triple point and to uniformly distribute an electric field on the surface of the insulation member. Further, when the insulation member is applied as a GIS spacer, size reduction is possible, resulting in cost reduction.

In the above, even though the components constituting the embodiments of the present invention are described as being combined or operated in combination as a single unit, the present invention is not necessarily limited to such embodiments. That is, as long as it is within the object scope of the present invention, the components may be selectively combined and operated in one or more groups. In addition, the terms "include", "consist of" or "have" as described above means that the corresponding component can be inherent, unless specifically stated to the contrary, and it should be interpreted that other components can be further included, and are not necessarily excluded. Unless all terms including technical and scientific terms used have other definitions, they are to be understood as having meanings commonly understood by those of ordinary skill in the art to which the present invention pertains. Commonly used terms, such as those defined in a dictionary, should be interpreted as being consistent with the contextual meaning of the related art, and are not to be interpreted according to ideal or excessively formal meanings unless explicitly defined in the present invention.

The above description is only to illustrate the technical idea of the present invention by way of example, and those of ordinary skill in the art to which the present invention pertains will appreciate that various modifications and variations are possible without departing from the essential characteristics of the present invention. Therefore, the embodiments disclosed in the present invention are not intended to limit the technical spirit of the present invention, but to explain the same, and the scope of the technical spirit of the present invention is not limited by these embodiments. The scope of protection of the present invention should be interpreted by the claims below, and all technical spirits within the scope equivalent thereto should be interpreted as being included in the scope of the present invention.

The invention claimed is:

1. A solid insulation member comprising:

a mixed material in which one or more materials selected from among polycarbonate (PC), polybutylene terephthalate (PBT), polyoxymethylene (POM), acrylonitrile-butadiene-styrene (ABS), polyamide (PA), and polyethylene terephthalate (PET), one or more fillers selected from among $TiO_2$, $SiO_2$, and $Al_2O_3$, and a curing agent are mixed, wherein the mixed material containing different amounts of the fillers at predetermined intervals in a longitudinal direction is stacked.

2. The insulation member of claim 1, wherein stacking is performed so that an amount of the filler is gradually increased stepwise from one side to another side in a longitudinal direction of a cross section of the insulation member.

3. The solid insulation member of claim 1, wherein stacking is performed so that an amount of the filler is gradually increased stepwise from one side to a central part in the longitudinal direction of a cross section of the insulation member and so that the amount of the filler is gradually reduced stepwise from the central part to another side.

4. The solid insulation member of claim 1, wherein the stacking is performed so as to be inclined at a predetermined angle relative to a virtual vertical line formed in the longitudinal direction of the cross section of the insulation member.

5. The solid insulation member of claim 4, wherein a mixed material is stacked so as to contain a filler in an amount that is relatively larger in a terminal end of the insulation member, defined by a virtual central line forming an acute angle in a longitudinal direction with respect to a virtual horizontal line perpendicular to the virtual vertical line, than in a portion other than the terminal end.

6. A method of manufacturing a solid insulation member, the method comprising:

manufacturing a 3D printing material using a mixed material in which one or more materials selected from among polycarbonate (PC), polybutylene terephthalate (PBT), polyoxymethylene (POM), acrylonitrile-butadiene-styrene (ABS), polyamide (PA), and polyethylene terephthalate (PET), one or more fillers selected from among $TiO_2$, $SiO_2$, and $Al_2O_3$, and a curing agent are mixed, and which contains different amounts of the fillers at predetermined intervals in a longitudinal direction; and sequentially stacking the manufactured 3D printing material using a 3D printer to thus manufacture a target insulation member so that the mixed material containing different amounts of the fillers at predetermined intervals in a longitudinal direction of a cross section of the target insulation member is sequentially stacked.

7. The method of claim 6, wherein the stacking is performed so that an amount of the filler is gradually increased stepwise from one side to another side in the longitudinal direction of the cross section of the insulation member, thus manufacturing the insulation member.

8. The method of claim 6, wherein the stacking is performed so that an amount of the filler is gradually reduced stepwise from one side to a central part in the longitudinal direction of the cross section of the insulation member and so that the amount of the filler is gradually increased from the central part to another side for each layer, thus manufacturing the insulation member.

9. The method of claim 6, wherein, when the 3D printing material is stacked to manufacture the insulation member, the stacking is performed so as to be inclined at a predetermined angle relative to a virtual vertical line formed in the longitudinal direction of the cross section of the insulation member.

10. A solid insulation member manufactured using the method of manufacturing the solid insulation member of claim 6.

11. A method of manufacturing a solid insulation member, the method comprising:

manufacturing n 3D printing materials using mixed materials in which one or more materials selected from among polycarbonate (PC), polybutylene terephthalate (PBT), polyoxymethylene (POM), acrylonitrile-butadiene-styrene (ABS), polyamide (PA), and polyethylene terephthalate (PET), one or more fillers selected from among $TiO_2$, $SiO_2$, and $Al_2O_3$, and a curing agent are mixed and which contain mutually different amounts of the fillers; and sequentially stacking the manufactured n 3D printing materials using a 3D printer to thus manufacture a target insulation member so that a first 3D printing material to a n-th 3D printing material of the n 3D printing materials are stacked at predetermined intervals in a longitudinal direction of a cross section of the insulation member.

12. The method of claim 11, wherein the stacking is performed so that an amount of the filler is gradually increased stepwise from one side to another side in the longitudinal direction of the cross section of the insulation member, thus manufacturing the insulation member.

13. The method of claim 11, wherein the stacking is performed so that an amount of the filler is gradually reduced stepwise from one side to a central part in the longitudinal direction of the cross section of the insulation member and so that the amount of the filler is gradually increased from the central part to another side for each layer, thus manufacturing the insulation member.

14. The method of claim 11, wherein, when the 3D printing material is stacked to manufacture the insulation member, the stacking is performed so as to be inclined at a predetermined angle relative to a virtual vertical line formed in the longitudinal direction of the cross section of the insulation member.

15. A solid insulation member manufactured using the method of manufacturing the solid insulation member of claim 11.

* * * * *